US007900315B2

(12) United States Patent
Cunningham

(10) Patent No.: US 7,900,315 B2
(45) Date of Patent: Mar. 8, 2011

(54) INTEGRATED CENTRAL VACUUM CLEANER SUCTION DEVICE AND CONTROL

(75) Inventor: J. Vern Cunningham, Aurora (CA)

(73) Assignee: Cube Investments Limited, Aurora (CA)

( * ) Notice: Subject to any disclaimer, the term of this patent is extended or adjusted under 35 U.S.C. 154(b) by 699 days.

(21) Appl. No.: 11/245,219

(22) Filed: Oct. 7, 2005

(65) Prior Publication Data

US 2007/0079469 A1 Apr. 12, 2007

(51) Int. Cl.

| | |
|---|---|
| ***A47L 5/38*** | (2006.01) |
| ***A47L 15/00*** | (2006.01) |
| ***A47L 5/00*** | (2006.01) |
| ***A47L 11/00*** | (2006.01) |
| ***A47L 13/00*** | (2006.01) |
| ***A63B 47/04*** | (2006.01) |
| ***A63D 5/10*** | (2006.01) |

(52) U.S. Cl. ..... 15/319; 15/301; 15/413

(58) Field of Classification Search ..... 15/301–319, 15/413

See application file for complete search history.

(56) References Cited

U.S. PATENT DOCUMENTS

| | | | | |
|---|---|---|---|---|
| 1,601,531 | A | | 9/1926 | Jeannin |
| 1,883,288 | A | | 10/1932 | Zubaty |
| 3,088,484 | A | * | 5/1963 | Marsh ..... 137/360 |
| 3,382,524 | A | | 5/1968 | Sandstrom |
| 3,477,689 | A | | 11/1969 | Berghoefer |
| 3,483,503 | A | | 12/1969 | Pardiso |
| 3,565,103 | A | | 2/1971 | Maselek |
| 3,570,809 | A | | 3/1971 | Stuy |
| 3,626,545 | A | | 12/1971 | Sparrow |
| 3,628,769 | A | | 12/1971 | Lee |
| 3,661,356 | A | | 5/1972 | Tucker |
| 3,663,845 | A | | 5/1972 | Apstein |
| 3,676,986 | A | | 7/1972 | Reiling |
| 3,826,464 | A | | 7/1974 | Berghoefer |
| 3,855,665 | A | | 12/1974 | Schwartz |
| 3,965,526 | A | | 6/1976 | Doubleday |
| 3,989,311 | A | | 11/1976 | Debrey |
| 4,056,334 | A | | 11/1977 | Fortune |
| 4,070,586 | A | | 1/1978 | Breslin |

(Continued)

FOREIGN PATENT DOCUMENTS

EP 0 192 469 A2 8/1986

(Continued)

OTHER PUBLICATIONS

Japan Patent Office, English translation of publication No. JP 2005-102465 A2, Generator Motor Coupled Integrally With Control Unit, publication date Apr. 14, 2005, printed Feb. 1, 2006, pp. 42.

(Continued)

*Primary Examiner* — Bryan R Muller
(74) *Attorney, Agent, or Firm* — Dowell & Dowell, P.C.

(57) ABSTRACT

An integrated apparatus has a cooling section, a motor section, a suction section and control module. The motor section drives the suction section to draw vacuum air through inlet and exhaust vacuum air through outlet. The motor section also drives the cooling section to draw cooling air through cooling air inlet, and push it through the motor section to cool the motor section. The control module controls the operation of the motor section. The control module is located in the cooling air path after the motor section. The cooling air for the motor section also cools the control module. The cooling section, motor section, suction section and control module are integrally mounted to form a single unit.

18 Claims, 6 Drawing Sheets

U.S. PATENT DOCUMENTS

| | | | | | |
|---|---|---|---|---|---|
| 4,111,615 | A | | 9/1978 | Watanabe | |
| 4,114,557 | A | | 9/1978 | De Brey | |
| 4,175,892 | A | | 11/1979 | De Brey | |
| 4,225,272 | A | | 9/1980 | Palmovist | |
| 4,227,258 | A | | 10/1980 | Root et al. | |
| 4,246,675 | A | | 1/1981 | Costanzo | |
| 4,300,262 | A | | 11/1981 | Rodowsky, Jr. et al. | |
| 4,336,427 | A | | 6/1982 | Lindsay | |
| 4,368,348 | A | | 1/1983 | Eichelberger et al. | |
| 4,369,543 | A | | 1/1983 | Chen et al. | |
| 4,370,776 | A | | 2/1983 | Kullik | |
| 4,443,906 | A | | 4/1984 | Tucker et al. | |
| 4,473,923 | A | | 10/1984 | Neroni et al. | |
| 4,490,575 | A | | 12/1984 | Kutnyak | |
| 4,494,270 | A | | 1/1985 | Ritzau et al. | |
| 4,513,469 | A | | 4/1985 | Godfrey et al. | |
| 4,531,796 | A | | 7/1985 | Gansert et al. | |
| 4,536,674 | A | | 8/1985 | Schmidt | |
| 4,591,368 | A | | 5/1986 | MacDuff | |
| 4,611,365 | A | | 9/1986 | Komatsu et al. | |
| 4,654,924 | A | | 4/1987 | Getz et al. | |
| 4,664,457 | A | | 5/1987 | Suchy | |
| 4,680,827 | A | | 7/1987 | Hummel | |
| 4,683,515 | A | | 7/1987 | Beihoff et al. | |
| 4,688,596 | A | | 8/1987 | Liebmann | |
| 4,693,324 | A | | 9/1987 | Choiniere et al. | |
| 4,731,545 | A | | 3/1988 | Lerner et al. | |
| 4,757,574 | A | | 7/1988 | Sumerau | |
| 4,766,628 | A | | 8/1988 | Walker | |
| 4,791,700 | A | | 12/1988 | Bigley et al. | |
| 4,829,625 | A | | 5/1989 | Wang | |
| 4,829,626 | A | | 5/1989 | Harkonen et al. | |
| 4,854,887 | A | | 8/1989 | Blandin | |
| 4,881,909 | A | | 11/1989 | Blackman | |
| 4,883,982 | A | * | 11/1989 | Forbes et al. | 310/62 |
| D315,043 | S | | 2/1991 | Hayden | |
| 4,991,253 | A | | 2/1991 | Rechsteiner | |
| 5,033,151 | A | | 7/1991 | Kraft et al. | |
| 5,067,394 | A | | 11/1991 | Cavallero | |
| 5,068,555 | A | * | 11/1991 | Oberdorfer-Bogel | 310/52 |
| 5,107,565 | A | | 4/1992 | Chun | |
| 5,109,568 | A | | 5/1992 | Rohn et al. | |
| 5,111,841 | A | | 5/1992 | Houston | |
| 5,120,983 | A | | 6/1992 | Samaan | |
| 5,125,125 | A | | 6/1992 | Barsacq | |
| D333,023 | S | | 2/1993 | Herron, Jr. | |
| 5,185,705 | A | | 2/1993 | Farrington | |
| D334,447 | S | | 3/1993 | Rohn | |
| 5,191,673 | A | | 3/1993 | Damizet | |
| 5,207,498 | A | | 5/1993 | Lawrence et al. | |
| 5,244,409 | A | | 9/1993 | Guss et al. | |
| 5,255,409 | A | | 10/1993 | Fujiwara et al. | |
| 5,263,502 | A | | 11/1993 | Dick | |
| 5,265,305 | A | | 11/1993 | Kraft et al. | |
| 5,274,578 | A | | 12/1993 | Noeth | |
| 5,274,878 | A | | 1/1994 | Radabaugh et al. | |
| 5,276,434 | A | | 1/1994 | Brooks et al. | |
| 5,276,939 | A | | 1/1994 | Uenishi | |
| 5,277,468 | A | | 1/1994 | Blatt et al. | |
| 5,298,821 | A | | 3/1994 | Michel | |
| 5,301,385 | A | | 4/1994 | Abe et al. | |
| 5,311,639 | A | | 5/1994 | Boshler | |
| 5,343,590 | A | | 9/1994 | Radabaugh | |
| 5,347,186 | A | | 9/1994 | Konotchick | |
| 5,349,146 | A | | 9/1994 | Radabaugh | |
| 5,353,468 | A | | 10/1994 | Yap et al. | |
| 5,363,534 | A | | 11/1994 | Dekker et al. | |
| 5,379,796 | A | | 1/1995 | Wang | |
| 5,391,064 | A | | 2/1995 | Lopez | |
| 5,404,612 | A | | 4/1995 | Ishikawa | |
| 5,409,398 | A | | 4/1995 | Chadbourne et al. | |
| 5,448,827 | A | | 9/1995 | Ward | |
| D364,014 | S | | 11/1995 | Langeland et al. | |
| 5,479,676 | A | | 1/1996 | Martin et al. | |
| 5,504,971 | A | | 4/1996 | McCormick | |
| 5,512,883 | A | | 4/1996 | Lane, Jr. | |
| 5,515,572 | A | | 5/1996 | Hoekstra et al. | |
| 5,525,842 | A | | 6/1996 | Leininger | |
| 5,542,146 | A | * | 8/1996 | Hoekstra et al. | 15/319 |
| 5,554,049 | A | | 9/1996 | Reynolds | |
| 5,560,076 | A | | 10/1996 | Leung | |
| 5,568,374 | A | | 10/1996 | Lindeboom et al. | |
| 5,572,767 | A | | 11/1996 | Ishikawa | |
| 5,578,795 | A | | 11/1996 | Ward | |
| 5,606,767 | A | | 3/1997 | Crienjak | |
| 5,655,884 | A | | 8/1997 | Rose | |
| 5,698,957 | A | | 12/1997 | Sowada | |
| 5,713,656 | A | | 2/1998 | Lin | |
| 5,722,110 | A | | 3/1998 | McIntyre et al. | |
| 5,737,797 | A | * | 4/1998 | Rittmueller et al. | 15/326 |
| 5,737,798 | A | | 4/1998 | Moren et al. | |
| 5,740,581 | A | | 4/1998 | Harrelson, II | |
| 5,740,582 | A | | 4/1998 | Harrelson, II | |
| 5,747,973 | A | | 5/1998 | Robitaille et al. | |
| 5,753,989 | A | | 5/1998 | Syverson et al. | |
| 5,813,085 | A | * | 9/1998 | Fritz et al. | 15/314 |
| 5,815,883 | A | | 10/1998 | Stein et al. | |
| 5,815,884 | A | | 10/1998 | Imamura | |
| 5,816,685 | A | | 10/1998 | Hou | |
| 5,850,665 | A | | 12/1998 | Bousset | |
| 5,871,152 | A | | 2/1999 | Saney | |
| D406,422 | S | | 3/1999 | Burchard et al. | |
| 5,893,194 | A | | 4/1999 | Karmel | |
| 5,896,618 | A | | 4/1999 | Woo et al. | |
| 5,917,428 | A | * | 6/1999 | Discenzo et al. | 340/870.01 |
| 5,918,728 | A | | 7/1999 | Syverson | |
| 5,924,163 | A | | 7/1999 | Burns, Jr. | |
| 5,924,164 | A | | 7/1999 | Lindsay, Jr. | |
| 5,926,908 | A | | 7/1999 | Lindsay, Jr. | |
| 5,926,909 | A | | 7/1999 | McGee | |
| 5,938,061 | A | | 8/1999 | Ward et al. | |
| 5,945,749 | A | | 8/1999 | Li | |
| 5,983,443 | A | | 11/1999 | Redding | |
| 5,987,697 | A | | 11/1999 | Song et al. | |
| 6,011,334 | A | | 1/2000 | Roland | |
| 6,029,309 | A | | 2/2000 | Imamura | |
| 6,033,082 | A | | 3/2000 | Lin | |
| 6,049,143 | A | | 4/2000 | Simpson et al. | |
| 6,101,667 | A | | 8/2000 | Ishikawa | |
| D431,335 | S | | 9/2000 | Mehaffey et al. | |
| 6,143,996 | A | | 11/2000 | Skanda | |
| 6,169,258 | B1 | | 1/2001 | Roney et al. | |
| 6,206,181 | B1 | | 3/2001 | Syverson | |
| 6,218,798 | B1 | | 4/2001 | Price et al. | |
| 6,232,696 | B1 | | 5/2001 | Kim et al. | |
| 6,239,576 | B1 | | 5/2001 | Breslin et al. | |
| 6,244,427 | B1 | | 6/2001 | Syerson | |
| 6,253,414 | B1 | | 7/2001 | Bradd et al. | |
| 6,256,833 | B1 | | 7/2001 | Steinberg | |
| 6,323,570 | B1 | | 11/2001 | Nishimura et al. | |
| 6,336,825 | B1 | | 1/2002 | Seefried | |
| 6,425,293 | B1 | | 7/2002 | Woodroffe et al. | |
| 6,459,056 | B1 | | 10/2002 | Graham | |
| 6,463,368 | B1 | | 10/2002 | Feiten et al. | |
| 6,488,475 | B2 | * | 12/2002 | Murata et al. | 417/32 |
| 6,546,814 | B1 | | 4/2003 | Choe et al. | |
| 6,628,019 | B2 | | 9/2003 | Carroll | |
| 6,658,325 | B2 | | 12/2003 | Zweig | |
| 6,685,491 | B2 | | 2/2004 | Gergek | |
| 6,690,804 | B2 | | 2/2004 | Everett | |
| D494,332 | S | | 8/2004 | Schroeter | |
| D494,333 | S | | 8/2004 | Schroeter | |
| 6,779,228 | B2 | * | 8/2004 | Plomteux et al. | 15/326 |
| 6,791,205 | B2 | | 9/2004 | Woodbridge | |
| 6,817,058 | B1 | | 11/2004 | Harrelson, II | |
| 6,822,353 | B2 | | 11/2004 | Koga et al. | |
| 6,864,594 | B2 | | 3/2005 | Seki | |
| 6,900,565 | B2 | | 5/2005 | Preston | |
| 6,975,043 | B2 | | 12/2005 | Schumacher et al. | |
| 6,975,993 | B1 | | 12/2005 | Lin | |
| 7,051,398 | B2 | | 5/2006 | Smith et al. | |
| 7,080,425 | B2 | | 7/2006 | Smith et al. | |
| 7,114,216 | B2 | | 10/2006 | Stephens et al. | |
| 7,122,921 | B2 | | 10/2006 | Hall et al. | |
| 7,237,298 | B2 | | 7/2007 | Reindle et al. | |
| 7,269,877 | B2 | | 9/2007 | Tondra et al. | |
| 7,328,479 | B2 | | 2/2008 | Willenbring | |

| | | | | |
|---|---|---|---|---|
| 7,331,083 | B2 | 2/2008 | Overvaag et al. | |
| 7,342,372 | B2 | 3/2008 | Jonsson et al. | |
| 7,363,679 | B2 | 4/2008 | Zimmerle et al. | |
| 7,403,360 | B2 | 7/2008 | Cunningham et al. | |
| 7,406,744 | B2 * | 8/2008 | Bruneau | 15/413 |
| 2002/0001190 | A1 | 1/2002 | Everett | |
| 2002/0042965 | A1 * | 4/2002 | Salem et al. | 15/339 |
| 2002/0127916 | A1 | 9/2002 | Zhang | |
| 2002/0152576 | A1 | 10/2002 | Murray et al. | |
| 2003/0044243 | A1 | 3/2003 | Tisdale | |
| 2003/0140443 | A1 | 7/2003 | Najm | |
| 2003/0196293 | A1 | 10/2003 | Ruff | |
| 2004/0031506 | A1 | 2/2004 | Tsai | |
| 2004/0049868 | A1 | 3/2004 | Ng | |
| 2004/0144633 | A1 | 7/2004 | Gordon et al. | |
| 2004/0150271 | A1 | 8/2004 | Koga et al. | |
| 2004/0172782 | A1 | 9/2004 | Smith et al. | |
| 2004/0177468 | A1 | 9/2004 | Smith et al. | |
| 2004/0231090 | A1 * | 11/2004 | Kushida et al. | 15/326 |
| 2004/0261211 | A1 | 12/2004 | Overvaag et al. | |
| 2005/0022329 | A1 | 2/2005 | Harman et al. | |
| 2005/0022337 | A1 * | 2/2005 | Roney et al. | 15/412 |
| 2005/0166351 | A1 | 8/2005 | Cunningham et al. | |
| 2005/0236012 | A1 | 10/2005 | Josefsson et al. | |
| 2005/0245194 | A1 | 11/2005 | Hayes et al. | |
| 2005/0254185 | A1 * | 11/2005 | Cunningham | 361/23 |
| 2007/0283521 | A1 | 12/2007 | Foster et al. | |
| 2008/0066252 | A1 | 3/2008 | Herron, Jr. | |
| 2008/0222836 | A1 | 9/2008 | Cunningham | |
| 2008/0301903 | A1 | 12/2008 | Cunningham et al. | |

FOREIGN PATENT DOCUMENTS

| | | |
|---|---|---|
| EP | 0347223 | 12/1989 |
| EP | 0552978 | 7/1993 |
| EP | 0499235 | 9/1995 |
| EP | 0711023 | 5/1996 |
| EP | 0773619 | 5/1997 |
| GB | 2281507 | 3/1995 |
| GB | 2288115 | 10/1995 |
| JP | 5-3058160 | 5/1978 |
| JP | 5-3128158 | 11/1978 |
| JP | 60-026494 | 2/1985 |
| JP | 64-049526 | 2/1989 |
| JP | 2-152419 | 6/1990 |
| JP | 2-152420 | 6/1990 |
| JP | 4-017830 | 1/1992 |
| JP | 5-003839 | 1/1993 |
| JP | 5-317213 | 12/1993 |
| JP | 6-277167 | 10/1994 |
| JP | 7-095944 | 4/1995 |
| JP | 7322980 | 12/1995 |
| JP | 8-033596 | 2/1996 |
| JP | 8-065876 | 3/1996 |
| JP | 8-117165 | 5/1996 |
| JP | 8-240329 | 9/1996 |
| JP | 9-149871 | 6/1997 |
| JP | 10-094504 | 4/1998 |
| JP | 2000-116577 | 4/2000 |
| JP | 2001-137158 | 5/2001 |
| JP | 2002-078656 | 3/2002 |
| JP | 2002-320577 | 11/2002 |
| JP | 2003-235767 | 8/2003 |
| JP | 2009-058919 | 3/2009 |
| WO | 9737423 | 10/1997 |
| WO | 9741631 | 11/1997 |
| WO | 98/35160 | 8/1998 |
| WO | 99/09875 | 3/1999 |
| WO | 9956606 | 11/1999 |
| WO | 0064323 | 11/2000 |
| WO | 2005/031169 | 4/2005 |
| WO | 2007/017057 | 2/2007 |

OTHER PUBLICATIONS

Audioetcetera, Wireless Remote Control for Filtex Vacuum Systems, http://www.audio-etcetera.com/prod.itml/icOid/135540, 1 page.

Central Vacuum Systems Owners Guide, M&S Systems, 6 pages.

Heritage Central Vacuum, Crush Proof Hoses Non-Electric, http://www.heritagevac.com/hosesnonelectric.html, printed Sep. 21, 2005, pp. 4, Azusa, USA.

New Central Vacuum Breaks Home Automation Barrier, Business Wire dated Feb. 26, 2002, 2 pages.

The Eureka Company, Cordless, Rechargeable Vacuum Cleaner, Household Type, Owner's Guide, Model 570, 2000, pp. 12, Bloomington, USA.

The Eureka Company, Cordless, Rechargeable Vacuum Cleaner, Household Type, Owner's Guide, Model 96B, 2001, pp. 12, Bloomington, USA.

Ultimate Air Inc., The UltimateAir RecoupAerator 200DX Energy Recovery Ventilator, Owner's Manual and Installation Guide, Jan. 24, 2006, pp. i-iv, 1-41Athens, USA.

* cited by examiner

INTEGRATED CENTRAL VACUUM CLEANER SUCTION DEVICE AND CONTROL

FIELD OF THE INVENTION

The invention relates to suction devices for central vacuum cleaning systems.

BACKGROUND OF THE INVENTION

Central vacuum cleaning systems were originally quite simple. One placed a powerful central vacuum source external to the main living space. The source was connected through interior walls to a long flexible hose that terminated in a handle and nozzle. When an operator desired to use the system, the operator went to the source and turned it on. The operator then went inside, picked up the handle and directed the nozzle to an area to be cleaned.

Although many elements of the basic system remain, many improvements have been made. Rigid pipes typically run inside interior walls to numerous wall valves spaced throughout a building. This allows an operator to utilize a smaller hose while covering an equivalent space. This is an advantage as the hose can be quite bulky and heavy.

Various communication systems have been developed. Some systems sense sound or pressure in the pipes to turn the vacuum source on or off, see for example U.S. Pat. No. 5,924,164 issued 20 Jul. 1999 to Edward W. Lindsay under title ACOUSTIC COMMUNICATOR FOR CENTRAL VACUUM CLEANERS. Other systems run low voltage wires between the source and the wall valve. The source can be turned on and off at a wall valve by a switch that may be activated by insertion or removal of the hose. The hose may also contain low voltage wires to allow the source to be controlled from a switch in the handle, see for example U.S. Pat. No. 5,343,590 issued 6 Sep. 1994 to Kurtis R. Radabaugh under title LOW VOLTAGE CENTRAL VACUUM CONTROL HANDLE WITH AN AIR FLOW SENSOR. The switch can be a simple toggle switch, or a more sophisticated capacitive switch.

The low voltage wires running along the pipes can be replaced by conductive tape or the like on the pipes, see for example U.S. Pat. No. 4,854,887 issued 8 Aug. 1989 to Jean-Claude Blandin under title PIPE SYSTEM FOR CENTRAL SUCTION CLEANING INSTALLATION. Separate low voltage conductors in the walls can be avoided altogether by home using mains power wires to transmit communication signals between the wall valve and the source, see for example U.S. Pat. No. 5,274,878 issued 4 Jan. 1994 to Kurtis R. Radabaugh et al under title REMOTE CONTROL SYSTEM FOR CENTRAL VACUUM SYSTEMS. A handheld radio frequency wireless transmitter can be used by an operator to turn the source on or off, see for example U.S. Pat. No. 3,626,545 issued 14 Dec. 1971 to Perry W. Sparrow under title CENTRAL VACUUM CLEANER WITH REMOTE CONTROL.

Line voltage can be brought adjacent the vacuum wall valves and connected to the handle through separate conductors, or integrated spiral wound conductors on the hose. Line voltage can then be brought from the handle to powered accessories, such as an electrically-powered beater bar, connected to the nozzle. Line voltage can be switched on and off to the powered accessory using the same switch in the handle that controls the source. Alternatively, the powered accessory may have its own power switch.

A control module mounted to the central vacuum unit is typically used to control the vacuum source. As central vacuum cleaning systems have become more and more sophisticated, so has the control module.

Improvements to, or additional or alternative features for, central vacuum cleaning systems are desirable.

SUMMARY OF THE INVENTION

In a first aspect the invention provides an apparatus for use in a central vacuum cleaner unit. The device includes a high speed suction device having a cooling section, a motor section, and a suction section, and includes a control module. The motor section drives the suction section to draw vacuum air. The motor section drives the cooling section to provide cooling air for cooling the motor section. The control module controls power to the motor section. The control module and suction device are integrally mounted as a single unit.

The control module may be mounted in a path of the cooling air after the motor section. The control module may be affixed to the suction device. The control module may include a vibration sensor for sensing vibrations from the suction device. The control module may include a temperature sensor for sensing temperature of the suction device. The control module may include at least one environmental condition sensor for sensing at least one environmental condition of the suction device.

In a second aspect the invention provides a central vacuum unit for use in a central vacuum cleaning system. The unit includes the apparatus of the first aspect, a motor chamber, and a suction chamber. The apparatus is mounted such that vacuum air is drawn through the suction chamber by the suction section and cooling air is drawn through the motor chamber by the cooling section.

In a third aspect the invention provides a central vacuum cleaning system including the central vacuum unit of the second aspect, a handle, at least one wall valve, vacuum hose for connection between the handle and the wall valve, and piping for connection between the at least one wall valve and the central vacuum unit.

Other aspects of the invention will be evident from the principles contained in the description and drawings herein.

BRIEF DESCRIPTION OF THE DRAWINGS

For a better understanding of the present invention and to show more were clearly how it may be carried into effect, reference will now be made, by way of example, to the accompanying drawings which show the preferred embodiment of the present invention and in which.

DETAILED DESCRIPTION OF THE PREFERRED EMBODIMENT

Figure 2:
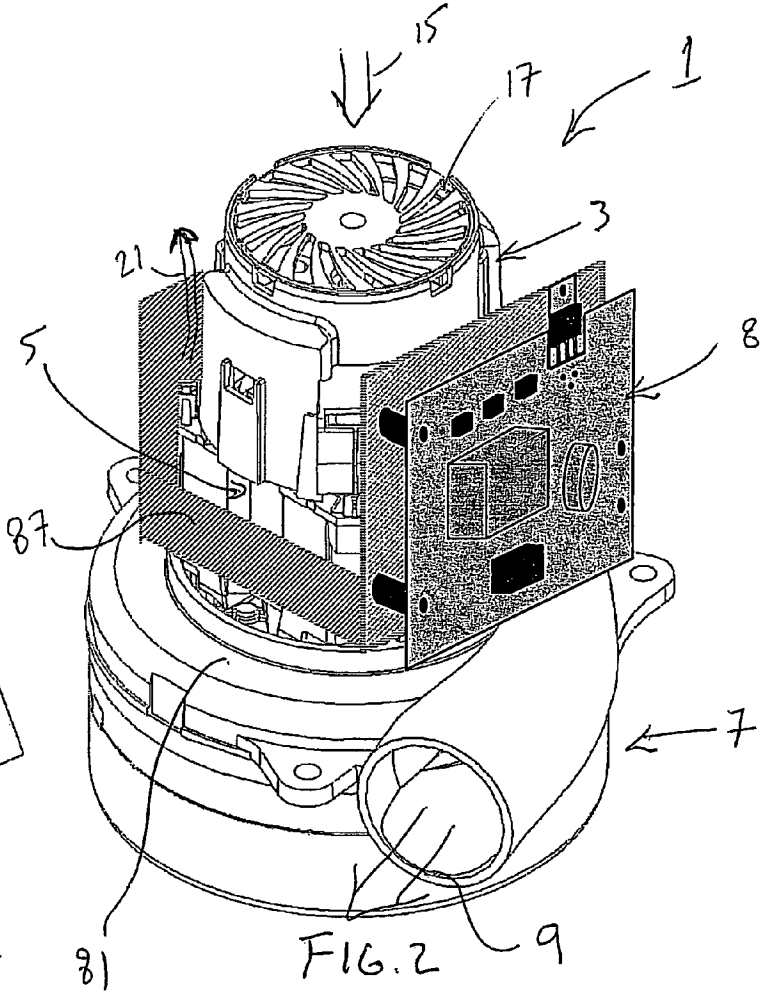
FIG. 2 is a perspective view of the apparatus of FIG. 1.

Referring to the FIGS., an integrated apparatus 1 has a suction device with a cooling section 3, a motor section 5, a suction section 7. The apparatus 1 also has a control module 8. The motor section 5 drives the suction section 7 to draw vacuum air, as shown by arrows 9, through inlet 11 and exhaust vacuum air through outlet 13. The motor section 5 also drives the cooling section 3 to draw cooling air, as shown by arrows 15, through cooling air inlet 17 and push it through the motor section 5, as shown by arrows 19, to cool the motor section 5.

The control module 8 controls the operation of the motor section 5. The control module 8 is located in the cooling air path after the motor section 5, as indicated by arrows 21. The cooling air for the motor section 5 also cools the control module 8.

The cooling section 3, motor section 5, suction section 7 and control module 8 are integrally mounted to form a single unit. This allows a designer of the apparatus 1 to ensure that components of the apparatus 1 are properly matched. It also allows the apparatus 1 to be certified as a whole. A central vacuum manufacturer will not need to obtain its own certification for a central vacuum unit in addition to a certification obtained for the apparatus 1 and the control module 8. Typically, a central vacuum manufacturer must obtain its own certification for the central vacuum unit as the separate mounting of a control and a motor in a central vacuum unit creates a device separate from the control and the motor for regulatory purposes.

Figure 3:
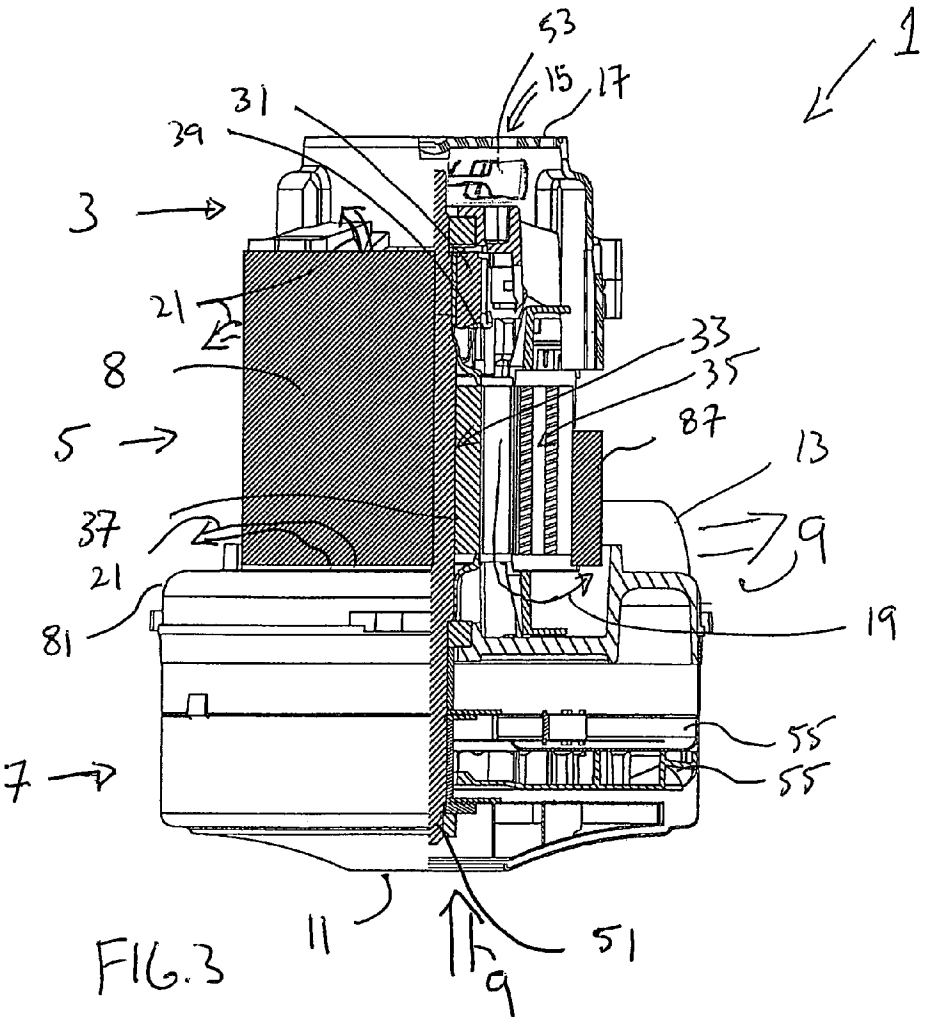
FIG. 3 is a side view of the apparatus of FIG. 1 cut-away along the line A-A' of FIG. 1.

Referring to FIG. 3, the motor section 5 in central vacuum applications is typically a universal motor having a commutator 31, rotor 33 and stator 35. The rotor 33 has rotor laminations 37 and rotor windings 39. The stator 35 has stator laminations 41 and stator windings 43. The rotor windings 39 and the stator windings, not shown, are powered through the commutator 31.

The rotor 33 is mounted on a shaft 51 such that rotation of the rotor 33 causes the shaft 51 to rotate.

A universal motor is typically used in central vacuum applications to obtain the high speeds necessary for adequate suction. The principles described herein can be applied to other motors for central vacuum applications to the extent that such motors require a separate control module or that such motors require an air driven cooling section.

The cooling section 3 utilizes the shaft 51 and a set of rotary fan blades 53 to drive the cooling air. The fan blades 53 rotate with the shaft 51.

The suction section 7 will typically use a multi-stage impeller 55 mounted on the shaft 51. As the shaft 51 rotates the impeller 55 rotates and draws vacuum air 9 through the apparatus 1. As is known in the art, other suction sections 7 could be used.

Figure 4:
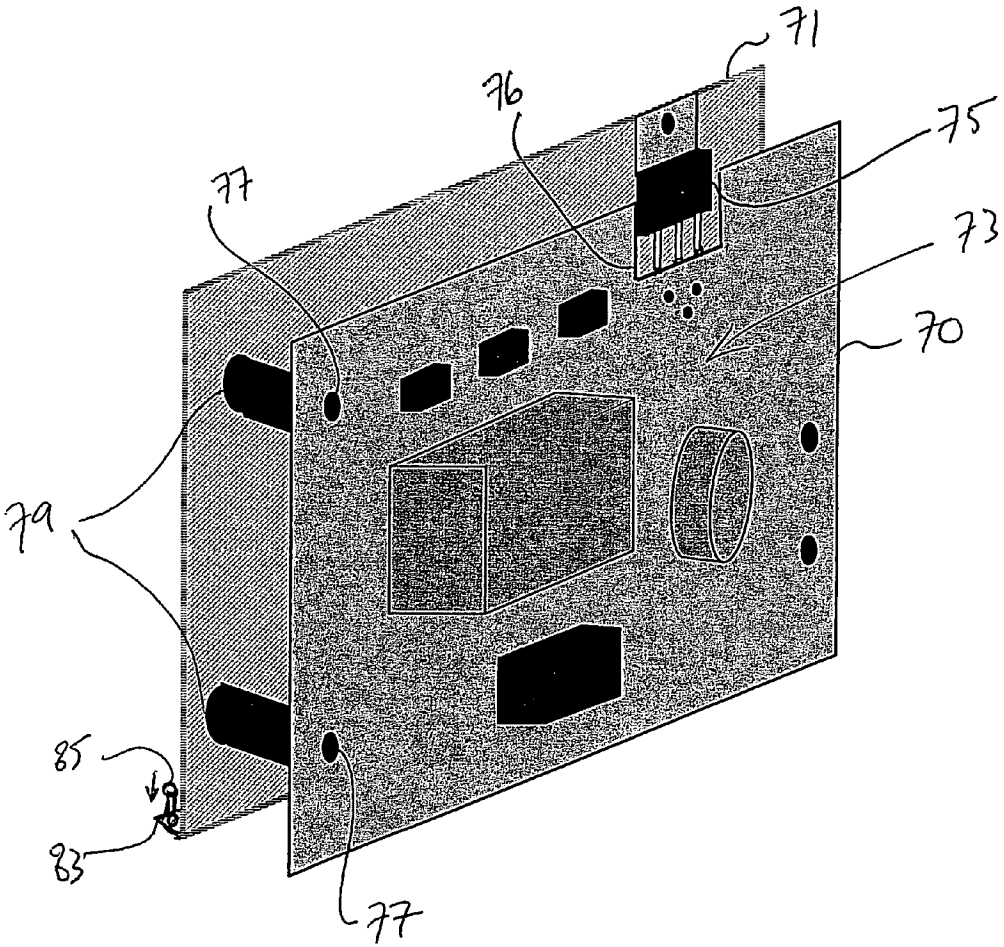
FIG. 4 is a perspective view of a control module used in the apparatus of FIG. 1.

Referring to FIG. 4 the control module 8 has a printed circuit board 70 and a heat sink 71. Components, indicated generally by 73, used in the control module 8 are mounted on the printed circuit board 70. Some components, for example power integrated circuits 75, are also mounted to the heat sink 71. These components 75, particularly when placed in a partially enclosed environment with other heat producing sources, require the additional cooling heat sink 71 can provide. As the control module 8 is in the cooling air path, the heat sink 71 can typically be smaller than a heat sink that is used for a control module mounted to the central vacuum unit housing as is known in the art.

Access through the printed circuit board 70 for mounting the components 75 to the heat sink 71 is provided by cutout 76. The components 75 must be held in thermal contact with the heat sink 71 for operation. The components 75 may be bolted to the heat sink 71; however, this may not be necessary as the components 75 will be held in place by solder at the printed circuit board 70. A thermally conductive paste may be used between the components 75 and the heat sink 71.

The heat sink 71 and printed circuit board 70 are mounted to one another using bolts or other securing members 77. A standoff 79 may be provided between the heat sink 71 and the printed circuit board 70 to allow for air flow between the heat sink 71 and the printed circuit board 70. The standoff 79 may be in the form of a sleeve about the securing member 77.

The control module 8 may be mounted in a variety of ways. For example, the control module 8 may be affixed to mounting plate 81 that forms an upper portion of the suction section 7 and a lower portion of the motor section 5. A mounting flange 83 may be provided on the heat sink 71 for this purpose. Bolts or other securing members 85 may be used to secure the flange 83 to the mounting plate 81.

The control module 8 may also be mounted by a strap 87 about the motor section 5. One or more standoffs, not shown, may be required in order to provide proper spacing to allow cooling air to flow from the motor section 5 across the heat sink 71. The strap 87 may be a continuous piece of material that extends around the motor section 5 and the heat sink 71. The strap 87 may be a continuous piece of material that is attached to the heat sink 71 on opposite sides of the motor section 5 and extends about the motor section 5. The strap 87 may also be made up of a series of straight pieces of material that are attached to one another to extend around the motor section 5.

Other possible ways of mounting the control module 8 will be evident to those skilled in the art based on the principles described herein.

The control module 8 may be shaped to fit around protrusions from the motor section 5.

Figure 5:
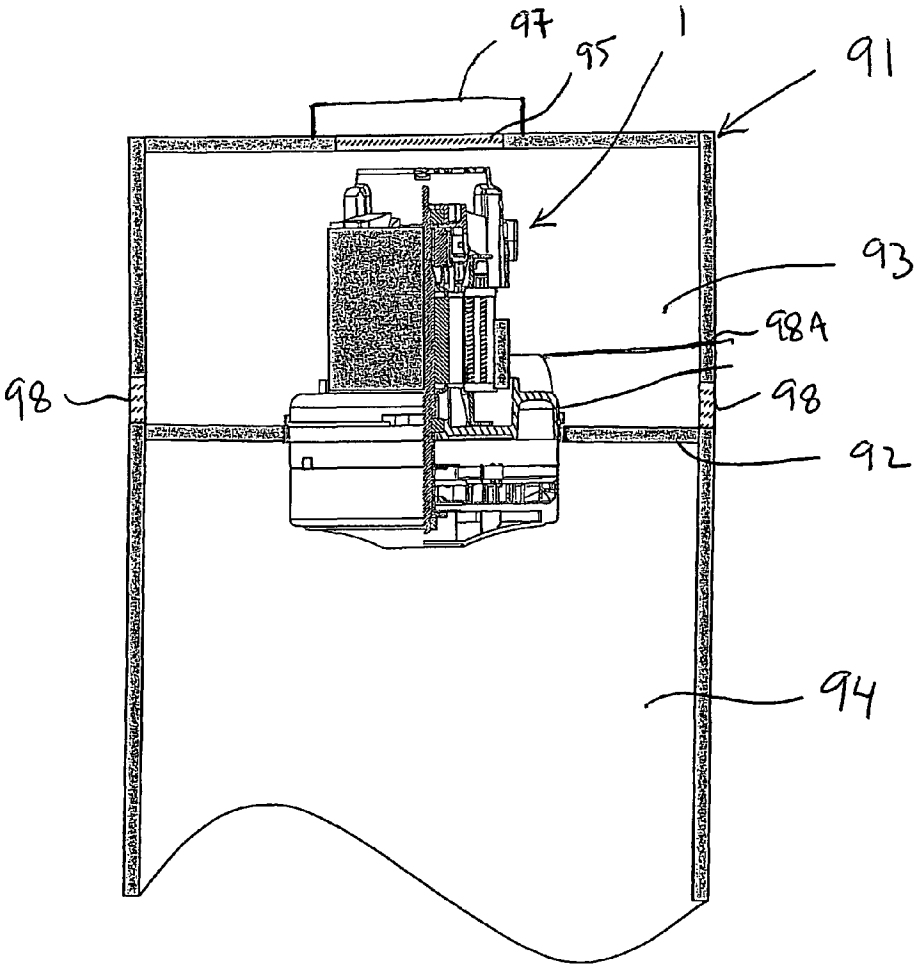
FIG. 5 is a side cross-section view of a preferred embodiment of a central vacuum unit containing the apparatus as shown in FIG. 4.

Referring to FIG. 5, in a central vacuum unit 91 the apparatus 1 may be secured at the mounting plate 81 to a mounting bracket 92 that divides a motor chamber 93 from a suction chamber 94. The motor section 5, cooling section 3 and control module 8 are in the motor chamber 93, while the suction section 7 is in the suction chamber 94. An aperture 95 is provided in the motor chamber 93 to allow ambient air to be drawn into the cooling section from outside the central vacuum unit 91 a portion of the apparatus 1 may protrude through the aperture 95. A shield 97 is usually mounted to the central vacuum unit 91 a distance above the apparatus 1 to ensure that cooling air is not inadvertently blocked by placing an object on the top of the central vacuum unit. Vents 98 are provided in the side of the motor chamber to allow cooling air to be exhausted from the unit. Vacuum air is exhausted from the unit 91 through piping 98A. The control module 8 fits between the mounting plate and the top of the motor chamber 93. Cooling air flows over and around the control module 8.

As will be evident to those skilled in the art, apparatus 1 may be mounted within the unit 91 in many alternative ways. For example, a portion of the apparatus 1 may protrude through the aperture 95. Also, the entire apparatus 1 may be within the motor chamber 93 with only an aperture, not shown, connecting the apparatus 1 to the suction chamber 94.

The control module 8 is placed in the cooling air path after the motor section 5 and does not adversely affect the cooling of the motor section 5.

Figure 1:
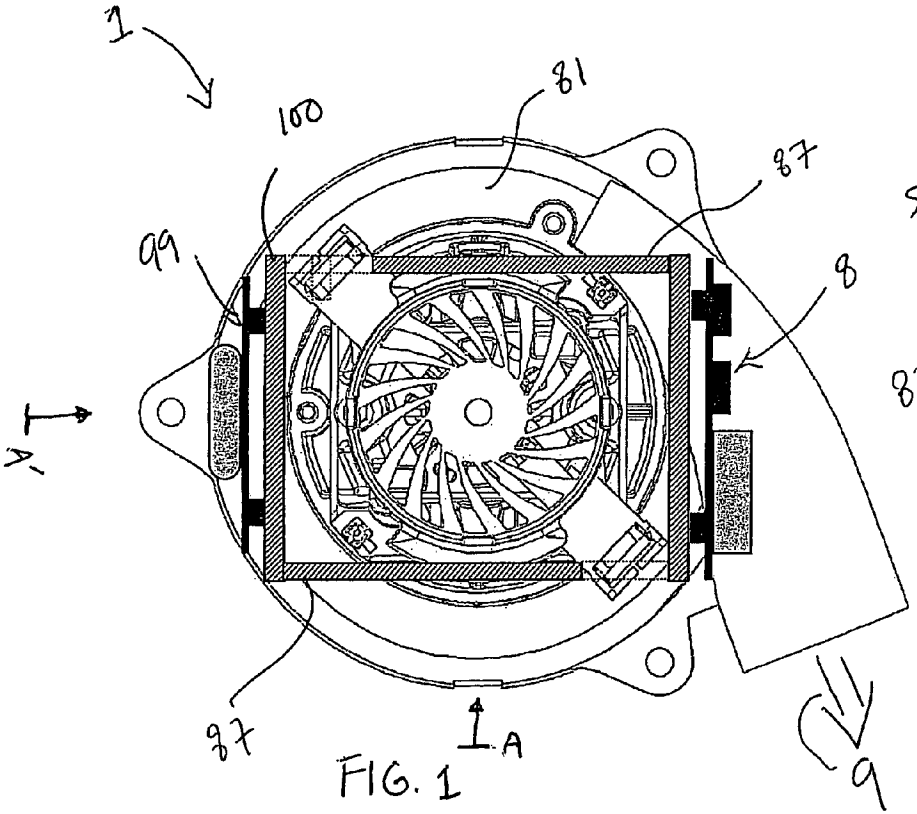
FIG. 1 is a top of view of an apparatus in accordance with a preferred embodiment of the present invention.

Referring again to FIGS. 1 and 2, as shown, an optional filter module 99 may be mounted to the apparatus 1 in a manner similar to the control module 8. For example, as shown in the FIGS., the filter module 99 may be mounted on an opposing side of the motor section 5 from the control module 8. The strap 87 may be in two pieces joining the filter module 99 and the control module 8. This is most easily done by bolting the straps 87 into heat sink 71 and a heat sink 100 of the filter module 99. The straps 87 can be set such that they provide a press fit on the stator laminations. Many stator laminations used in vacuum cleaner motors have four opposing external sides. Other mounting methods will be evident to those skilled in the art based on the principles described herein.

The filter module 99 filters out electromagnetic interference (EMI) that may otherwise enter power lines 101 (FIG. 6) connected to the apparatus 1. As the filter module 99 and control module 8 are mounted to the apparatus 1, all related connecting wire may be minimized. This reduces the radiating antenna effect of the wires. This in turn reduces secondary induced EMI between the wires and the power lines 101.

Figure 7:
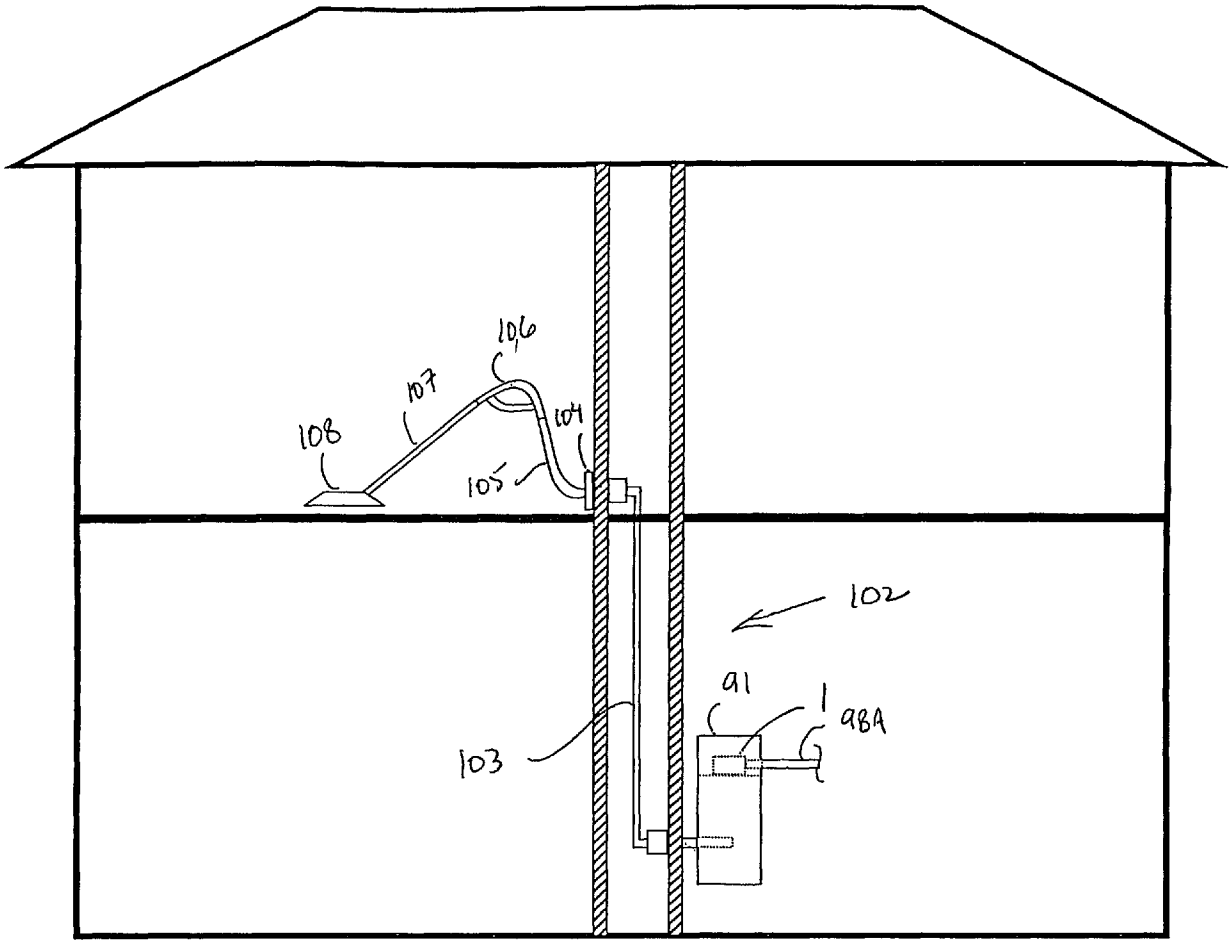
FIG. 7 is a side cross-section of a dwelling with a preferred embodiment of a central vacuum system incorporating the unit of FIG. 5.

Referring to FIG. 7, the central vacuum unit 91 is used to form part of a central vacuum system 102 utilizing piping 103, wall valves 104, hose 105, handle 106, wand 107, and attachments 108 in a similar manner to existing central vacuum cleaning systems uses existing suction devices.

Figure 6:
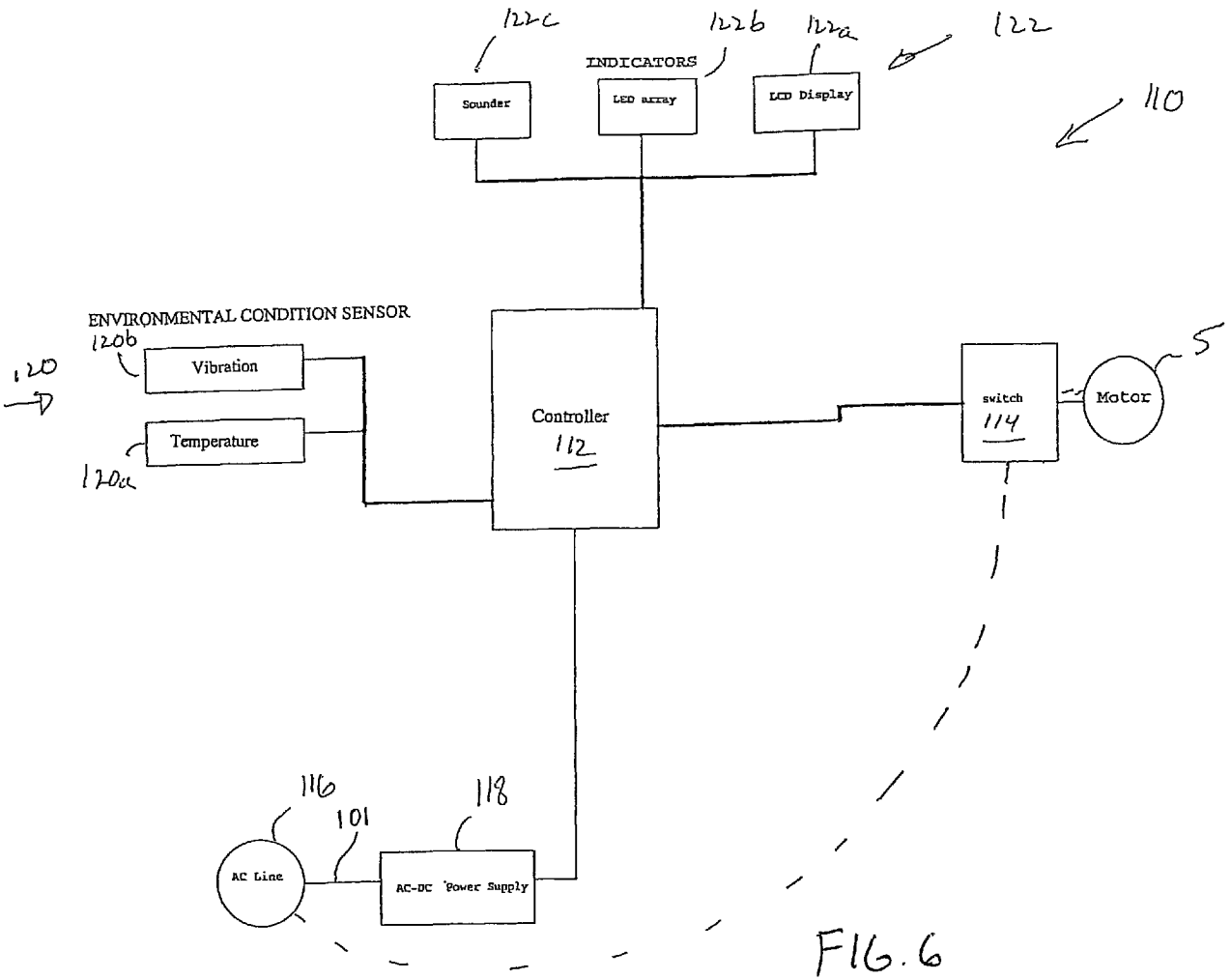
FIG. 6 is a block diagram of a preferred embodiment of a control circuit for a central vacuum unit containing the apparatus of FIG. 1.

Referring to FIG. 6, an example block diagram of a control circuit 110 for a central vacuum cleaning system 102 is shown. The control circuit 110 has a controller 112 and switch 114 for controlling line power 116 to motor section 5. The controller 112 and switch 114 form the control module 8 and are usually provided on a single printed circuit board 70. The switch 114 may, for example, be a relay or a triac, not shown.

The control module 8 typically includes an AC-DC power supply 118 for powering the controller 112 and other components. Optional environmental conditions sensors 120 may be included in the control module 8 or as inputs to the control module 8. The control module 8 may include indicators 122 for communication with a user. The indicators 122 may be remote from the control module 8.

The environmental condition sensors 120 sense information about the environment in which the control module 8 is located. Such sensors 120 may include, for example, a temperature sensor 120*a* or a vibration sensor 120*b*. Increased temperatures in the central vacuum unit 91 may indicate a problem with the apparatus 1, such as worn brushes in the motor. Similarly, vibrations may indicate a problem with the apparatus 1, such as worn bearings.

The physical location of the control module 8 in the cooling air path after the motor section 5 can provide an accurate measure of the temperature in the motor section 5. Mounting the control module 8 to the apparatus 1 can provide an accurate indication of vibration at the apparatus 1. The control module 8 can utilize inputs from a sensor 120 in any way desirable, for example, an alarm could be provided or power to the motor section 5 could be shut down.

The alarm or other communication may be transmitted from the control module 8 through wires or wirelessly for display through incorporating a display device, such as LCD display 122*a* or an LED array 122*b* or audible sounding through a sounder 122*c*, for example a speaker or a piezoelectric buzzer. Example communication configurations are described in the inventor's U.S. patent application Ser. No. 10/936,699 filed 9 Sep. 2004 and International Patent Application number PCT/CA2005/000715 filed 11 May 2005 under title Central Vacuum Cleaning System Control Subsystems the content of which are hereby incorporated by reference into this description.

It will be understood by those skilled in the art that this description is made with reference to the preferred embodiment and that it is possible to make other embodiments employing the principles of the invention which fall within its spirit and scope as defined by the following claims.

I claim:

1. An apparatus for use in a central vacuum unit for a central vacuum cleaning system, the apparatus comprising: a) a high speed suction device consisting of a cooling fan, a motor unit, and a suction unit, and b) a control module, wherein the motor unit drives the suction unit to draw vacuum air through the suction device, and the motor unit drives the cooling fan to provide cooling air for cooling the motor unit, and wherein the control module controls power to the motor unit, and wherein the control module is mounted directly to the suction device as a single unit, wherein the control module is mounted in a path of the cooling air external to the cooling fan, motor unit, and suction unit, and the apparatus further comprising a strap, and wherein the control module is directly mounted to the suction device by the strap.

2. The apparatus of claim 1, wherein the control module is mounted in a path of the cooling air after the motor unit.

3. The apparatus of claim 1, wherein the control module comprises a vibration sensor for sensing vibrations, and wherein the control module, motor unit, suction unit, and cooling fan are directly mounted such that vibrations from the motor unit are transmitted to the vibration sensor.

4. The apparatus of claim 1, wherein the control module comprises a temperature sensor for sensing temperature of the suction device.

5. The apparatus of claim 1, wherein the control module comprises at least one environmental condition sensor for sensing at least one environmental condition of the suction device.

6. The apparatus of claim 1 wherein the control module is directly mounted to the motor unit.

7. A central vacuum unit for use in a central vacuum cleaning system, the unit comprising:

a) an apparatus comprising: i) a high speed suction device consisting of a cooling fan, a motor unit, and a suction unit, and ii) a control module, wherein the motor unit drives the suction unit to draw vacuum air through the suction device, and the motor unit drives the cooling fan to provide cooling air for cooling the motor unit, and wherein the control module controls power to the motor unit, and wherein the control module is mounted directly to the suction device as a single unit, and wherein the control module is mounted in a path of the cooling air external to the cooling fan, motor unit, and suction unit, and the apparatus further comprising a strap, and wherein the control module is directly mounted to the suction device by the strap, b) a motor chamber, and c) a suction chamber, wherein the apparatus is mounted such that vacuum air is drawn through the suction chamber by the suction unit and cooling air is drawn through the motor chamber by the cooling fan, and wherein the control module is within, and open to, the motor chamber.

8. The unit of claim 7, wherein the control module is mounted in a path of the cooling air after the motor unit.

9. The unit of claim 7, wherein the control module comprises a vibration sensor for sensing vibrations, and wherein the control module, motor unit, suction unit, and cooling fan are directly mounted such that vibrations from the motor unit are transmitted to the vibration sensor.

10. The unit of claim 7, wherein the control module comprises a temperature sensor for sensing temperature of the suction device.

11. The unit of claim 7, wherein the control module comprises at least one environmental condition sensor for sensing at least one environmental condition of the suction device.

12. The unit of claim 7 wherein the control module is directly mounted to the motor unit.

13. A central vacuum cleaning system comprising:

a) a central vacuum unit comprising:

A) an apparatus comprising: i) a high speed suction device consisting of a cooling fan, a motor unit, and a suction unit, and ii) a control module, wherein the motor unit drives the suction unit to draw vacuum air through the suction device, and the motor unit drives the cooling fan to provide cooling air for cooling the motor unit, and wherein the control module controls power to the motor unit, and wherein the control module is mounted directly to the suction device as a single unit, and wherein the control module is mounted in a path of the cooling air external to the cooling fan, motor unit, and suction unit, and the apparatus further comprising a strap, and wherein the control module is directly mounted to the suction device by the strap, B) a motor chamber, and C) a suction chamber, wherein the apparatus is mounted such that vacuum air is drawn through the suction chamber by the suction unit and cooling air is drawn through the motor chamber by the cooling fan, and wherein the control module is within, and open to, the motor chamber, b) a handle, c) at least one wall valve, d) vacuum hose for connection between the handle and the wall valve, and e) piping for connection between the at least one wall valve and the central vacuum unit.

14. The system of claim 13, wherein the control module is mounted in a path of the cooling air after the motor unit.

15. The system of claim 13, wherein the control module comprises a vibration sensor for sensing vibrations, and wherein the control module, motor unit, suction unit, and cooling fan are directly mounted such that vibrations from the motor unit are transmitted to the vibration sensor.

16. The apparatus of claim 13, wherein the control module comprises a temperature sensor for sensing temperature of the suction device.

17. The apparatus of claim 13, wherein the control module comprises at least one environmental condition sensor for sensing at least one environmental condition of the suction device.

18. The system of claim 13 wherein the control module is directly mounted to the motor unit.

* * * * *